United States Patent [19]

Suddath

[11] Patent Number: 5,074,446

[45] Date of Patent: Dec. 24, 1991

[54] SEPARABLE MULTIPART HANGER WITH SHOULDER CAPS

[75] Inventor: James N. Suddath, West Bloomfield, Mich.

[73] Assignee: Electroformed Products, Inc., Royal Oak, Mich.

[21] Appl. No.: 632,983

[22] Filed: Dec. 24, 1990

Related U.S. Application Data

[63] Continuation-in-part of Ser. No. 548,581, Jul. 5, 1990.

[51] Int. Cl.[5] ..... A47G 25/40; A47G 25/14

[52] U.S. Cl. ..... 223/92; 223/85; 223/88; D6/315

[58] Field of Search ..... 223/85, 88, 92, 95, 223/98, 94; 211/113; D6/315, 318, 328

[56] References Cited

U.S. PATENT DOCUMENTS

| | | | |
|---|---|---|---|
| 1,312,997 | 11/1919 | Duberstein . | |
| 1,805,573 | 5/1931 | Dinsmore . | |
| 2,155,071 | 4/1939 | Young | 223/92 X |
| 2,160,128 | 5/1939 | Coney | 223/92 X |
| 2,160,129 | 5/1939 | Coney | 223/92 |
| 2,160,173 | 5/1939 | Ruew | 223/92 |
| 2,160,188 | 5/1939 | Young | 223/92 |
| 2,372,458 | 3/1945 | Tewell | 223/88 |
| 2,435,111 | 1/1948 | Wahl | 223/95 |
| 2,481,737 | 9/1949 | Gartner | 223/92 |
| 2,495,335 | 1/1950 | Lee et al. | 223/92 |
| 2,528,036 | 10/1950 | Cook | 223/92 |
| 2,562,368 | 7/1951 | Robison | 223/88 |
| 2,574,963 | 11/1951 | Dwyer | 223/88 |
| 2,590,738 | 3/1952 | Tufts | 223/98 |
| 2,591,163 | 4/1952 | Kivett | 223/92 |
| 2,614,736 | 10/1952 | Sarti | 223/92 |
| 2,652,957 | 9/1953 | Wolfe | 223/92 |
| 2,866,583 | 12/1958 | Batts | 223/88 |
| 3,212,687 | 10/1965 | Bradley | 223/98 |
| 3,460,727 | 8/1969 | Baughman | 223/98 |
| 3,484,029 | 12/1969 | Gaydos | 223/85 |
| 3,727,297 | 4/1973 | Wesemann | 29/480 |
| 4,058,291 | 11/1977 | Craig | 223/98 |
| 4,606,482 | 8/1986 | McHugh | 223/88 |
| 4,738,381 | 4/1988 | Marcin | 223/88 |
| 5,018,650 | 5/1991 | Mauffette | 223/85 X |

*Primary Examiner*—Werner H. Schroeder
*Assistant Examiner*—Bibhu Mohanty
*Attorney, Agent, or Firm*—Basile and Hanlon

[57] ABSTRACT

A separable, multipart hanger includes a hook portion having first and second legs. First and second shoulder rails are releasably mounted in the ends of the first and second legs and inclined outwardly from the hook portion. First and second shoulder caps are releasably joined to the opposite ends of the first and second shoulder rails. A horizontal rail is releasably attached to the opposite ends of the first and second shoulder caps. The exterior surface of the shoulder caps are smoothly curved. A friction producing surface is adhesively attached to the exposed portions of at least certain of the first and second shoulder rails and the horizontal rail.

13 Claims, 2 Drawing Sheets

SEPARABLE MULTIPART HANGER WITH SHOULDER CAPS

CROSS REFERENCE TO CO-PENDING APPLICATION

This application is a continuation-in-part application of co-pending U.S. patent application Ser. No. 07/548,581, filed on July 5, 1990 in the name of James N. Suddath and entitled TWO-PART PLASTIC HANGER AND METHOD OF MANUFACTURING SAME.

BACKGROUND OF THE INVENTION

1. Field of the Invention

The present invention relates, in general, to hangers and, more specifically, to plastic hangers.

2. State of the Art

Clothes hangers have been formed of a variety of materials including wire rods, wood, combinations thereof, and plastic. Such clothes hangers include a hook portion and two inclined, diverging shoulder rails, connected to and extending from the hook portion. Typically, a horizontal rail is connected between the outer ends of the shoulder rails for strength and to support pants, etc., on the hanger.

The most common type of hanger is formed of an integral, one-piece member of metal, wood or plastic which is formed into the hook, the inclined, diverging shoulder rails and the horizontal rail. The combined metal and wood hangers are formed of separate metal and wood pieces which are fixedly secured together for use as a hanger.

Plastic hangers are formed as an integral one-piece assembly, typically, by injection molding. Due to the size and shape of the hanger, the mold cavity is necessarily large thereby enabling only one or just a few hangers to be produced in a single mold in each run cycle. The production rate of such plastic hangers is, therefore, low.

Further, due to the triangular shape of a typical hanger, transportation and storage costs are generally high since the hanger, even though it weighs very little, consumes a large amount of space due to its triangular shape. The containers used to store and transport the hangers are required to be large enough to contain the entire hanger, even though a large portion of the volume of such containers are dead space, such as that enclosed by the shoulder rails and horizontal rail of each hanger.

Some types of hangers include a friction producing surface, such as flocking, to prevent clothes from falling off of the shoulder or horizontal rails. Typically, loose flocking fibers or particles are sprayed onto an adhesive coating previously applied to the horizontal rail and/or portions of the shoulder rails. However, due to the triangular shape of the interconnected shoulder rails and the horizontal rail, a considerable amount of the sprayed adhesive and flocking does not contact the hanger and is wasted which increases production costs.

Another feature found on some hangers is shoulder pads. Such shoulder pads are formed as enlarged areas at the apexes of the shoulder rails and the horizontal rail or as separate smoothly curved members which snap onto the apexes of a hanger. Such shoulder pads provide an enlarged, smooth surface which prevents wrinkles from being formed in clothing hung from the hanger. However, such shoulder rails are provided as an extra cost, attachment to an existing hanger or require a specially designed hanger in which the shoulder pads are integrally formed or molded into the hanger.

It would be desirable to provide a hanger which minimizes transportation and storage costs by being able to be transported or stored in a minimal amount of space. It would also be desirable to provide a hanger which can be separated into separate components for minimal storage space requirements. It would also be desirable to provide a hanger in which a friction producing surface, such as flocking, can be easily applied to desired portions of the hanger without waste. It would also be desirable to provide a hanger which can be constructed at less expense and from lower cost material, in smaller molds and molding machines, and at higher production rates than previously devised hangers, particularly plastic hangers. Finally, it would be desirable to provide a hanger which includes enlarged shoulder pad areas at a minimal additional cost.

SUMMARY OF THE INVENTION

The present invention, in a first embodiment, is a two-part plastic hanger, a method for manufacturing the same and a two-part plastic hanger preparable by the method.

The hanger includes a hook portion having first and second diverging legs. A second portion is engageable with the legs of the hook portion. The second portion includes first and second inclined shoulder rails, one end of each of which is engageable with the first and second legs, respectively, of the hook portion. A horizontal rail is integrally formed with and extends between one end of each of the first and second shoulder rails.

In this embodiment, the hook portion and the second portion of the hanger are made of plastic. Preferably, the hook portion is injection molded and the second portion is extruded in a hollow, tubular form before the shoulder rails are bent into the desired, angular shape with respect to the planar, horizontal rail. At least the ends of the shoulder rails of the second portion are hollow so as to slidably receive the first and second legs of the hook portion therein.

Further, a friction producing surface is optionally applied to at least portions of at least one of the first and second shoulder rails and the horizontal rail. Preferably, the friction producing surface comprises flocking particles or fibers which are sprayed onto an adhesive coating also sprayed over portions of at least one of the first and second shoulder rails and the horizontal rail.

The method of manufacturing a plastic hanger comprises the steps of:

(a) forming a hook portion having a substantially U-shaped end and first and second diverging legs, (b) extruding a hollow tube having first and second ends from a plastic material, (c) bending the hollow tube at opposite ends to form first and second inclined shoulder rails integrally connected by a planar, horizontal rail, and (d) slidably engaging the first and second legs of the hook portion with the ends of the first and second shoulder rails.

In a preferred embodiment, the hook portion is formed by injection molding the hook portion from a suitable plastic material.

In an optional embodiment of the method of the present invention, a friction producing surface is applied onto at least portions of at least one of the first and second shoulder rails and the horizontal rail of the hanger. Preferably, certain portions of the first and second shoulder rails or the horizontal rail are first coated by an adhesive. Flocking particles or fibers are then sprayed over the adhesive coating so as to be attached to the first and second shoulder rails and the horizontal rail by the adhesive coating. Preferably, the adhesive and the flocking fibers are sprayed onto the second portion of the hanger before the first and second shoulder rails are bent into the desired shape with respect to the horizontal rail from the elongated, extruded tube.

Also disclosed is a two-part plastic hanger having a hook portion with first and second, inclined, depending legs preparable by the method of extruding an elongated, hollow tubular member from a plastic material having first and second ends and bending the first and second ends of the tubular member to form first and second inclined shoulder rails joined by an integral horizontal rail, the first and second ends of the shoulder rails being engageable with the first and second legs, respectively, of the hook portion. The hanger formed by this method also may be prepared by spraying flocking particles or fibers over an adhesive coating previously sprayed onto certain portions of the first and second shoulder rails and the horizontal rail.

The two-part plastic hanger of the present invention overcomes many of the problems encountered with previously devised plastic hangers. Since only the hook portion of the two-part plastic hanger is injection molded, smaller quantities of higher cost injection molding plastic are required. Further, the small size of the hook portion as compared to the conventional large one-piece hanger having both hook portions and shoulder and horizontal rails, enables smaller, less expensive molds and molding machines to be employed to manufacture the hanger. More parts can also be produced in each mold thereby significantly increasing production rates and further lowering the overall cost of the plastic hanger of the present invention.

By extruding the second portion of the hanger in a hollow, elongated tubular form, smaller dies and molding machines may be employed. Further, higher production rates and less expensive plastic materials may be employed for the second portion of the hanger.

The friction surface in the form of adhesively mounted flocking particles or fibers is applied onto the extruded tube before the shoulder rails are bent to the desired shape. This enables quantities of the sprayed adhesive to adhere to the hanger thereby significantly reducing waste and requiring smaller equipment and less floor space than previous methods for applying flocking to large, one-piece hangers.

A second embodiment of the present invention is a separable, multipart hanger formed of a plurality of individual components which are releasably connectible to form a hanger.

The second embodiment of the hanger includes a hook portion having first and second diverging legs. Hollow bores are formed in the ends of the first and second diverging legs. One end of each of first and second shoulder rails is releasably mountable in the bores in the first and second diverging legs of the hook portion.

First and second shoulder caps are releasably connected to the opposite ends of the first and second shoulder rails, respectively. The shoulder caps have a smoothly curved exterior surface to smoothly support articles of clothing on the hanger. A horizontal rail is releasably connected to the opposite ends of the first and second shoulder caps to complete the hanger.

A friction producing surface, such as individual flocking fibers, are adhesively coated onto the upper exposed portions of at least certain of the first and second shoulder rails and the horizontal rail. The friction producing surface securely supports articles of clothing on the hanger without slippage.

Preferably, the first and second shoulder caps include latch means for releasably latching the ends of the first and second shoulder rails and the horizontal rail to each of the shoulder caps.

The hanger of this embodiment of the present invention is produced with a low manufacturing cost by injection molding the hook portion and the first and second shoulder caps and extruding the first and second shoulder rails and the horizontal rail as a continuous, extruded member through an extrusion die prior to the individual shoulder rails and the horizontal rail being cut to the desired length. The friction producing surface may be adhesively applied to the continuous strip as it exits the extrusion die to minimize waste of the friction producing particles and adhesive.

More importantly, the use of individual, separable components which may be releasably joined together to form a unitary hanger enables the components to be transported and shipped in a broken down, separated arrangement thereby saving a considerable amount of storage space in a container. This reduces transportation and storage costs as well as packaging costs since the hanger is transported and stored in a minimal amount of space.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
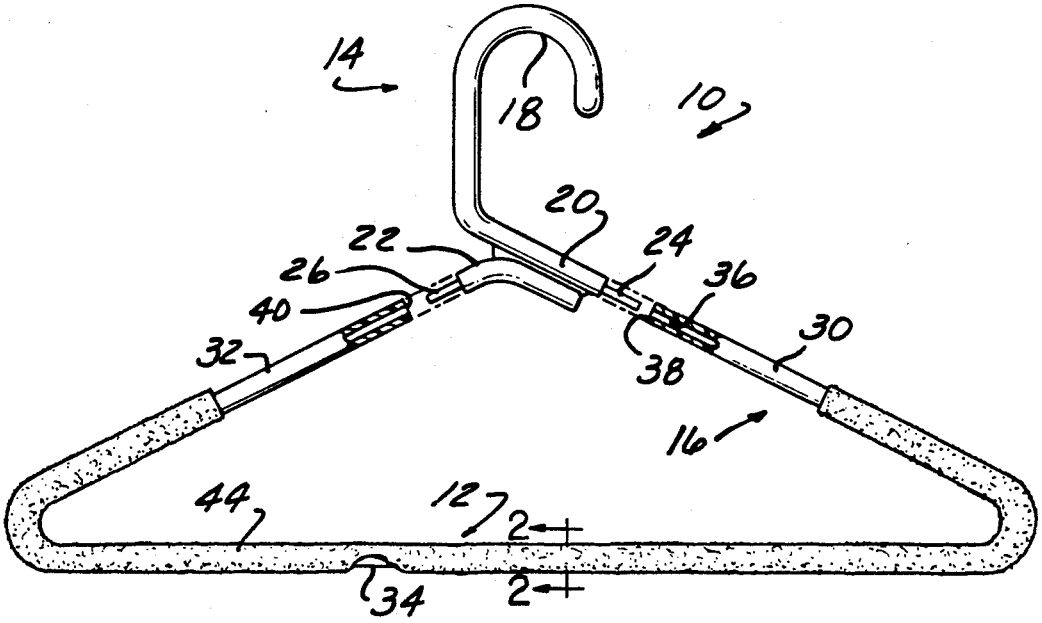
FIG. 1 is an exploded, front elevational view of a two-part hanger constructed in accordance with the teachings and method of the present invention.

Referring now to the drawing, and to FIG. 1 in particular, there is illustrated a two-part plastic hanger 10 constructed in accordance with the teachings of a first embodiment of the present invention. The two-part hanger 10 also includes a friction producing surface 12 on portions thereof as described hereafter.

The two-part hanger 10 includes a first hook portion 14 and a second, lower portion 16. The hook portion 14 has a conventional, U-shaped end 18 and integral, first and second, inclined, diverging legs 20 and 22, respectively. The hook portion 14 is preferably formed as a one-piece member by injection molding in a single mold cavity. Any suitable plastic material may be used to form the hook portion 14 of the two-part hanger 10.

Optionally, reduced diameter end portions 24 and 26, each of which has a smaller diameter or outside dimension than the corresponding dimension of the first and second legs 20 and 22, extend outward from the ends of the first and second legs 20 and 22, respectively, as shown in FIG. 1.

The second lower portion 16 of the two-part hanger 10 includes first and second inclined legs 30 and 32, respectively. The first and second legs 30 and 32, which function as shoulder rails, are disposed at acute angles with respect to an integral, planar, horizontal rail 34. The horizontal rail 34 extends between one end of each of the first and second legs or shoulder rails 30 and 32 of the second lower portion 16 of the hanger 10.

As shown in FIG. 1, the second lower portion 16 is in the form of a hollow tubular member having an internal bore 36 extending therethrough from a first end 38 to a second end 40. Alternately, at least the end portions 38 and 40 of the first and second shoulder rails 30 and 32 are hollow; with the remainder of the first and second shoulder rails 30 and 32 and the horizontal rail 34 being formed as a solid member.

Optionally, a friction producing surface 12 is formed on at least certain portions of at least one or all of the first and second shoulder rails 30 and 32, respectively, and the horizontal rail 34, as shown in FIG. 1. The friction surface 12 is preferably formed by coating portions of the first and second shoulder rails 30 and 32 and/or the horizontal rail 34 with flocking fibers. Portions of the second lower portion 16 of the hanger 10 are first coated with a suitable adhesive prior to the flocking fibers being sprayed thereon. In this manner, the flocking fibers are adhesively attached to the second lower portion 16 and extend outward therefrom to form a friction producing surface for securely retaining garments on the first and second shoulder rails 30 and 32 and/or the horizontal rail 34.

Figure 2:
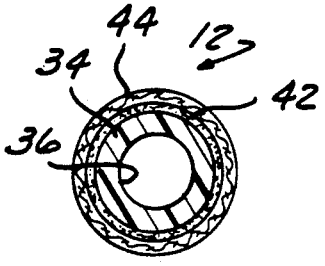
FIG. 2 is a cross sectional view generally taken along line 2—2 in FIG. 1.

As shown in FIG. 2, the flocking fibers 44 are disposed completely around the entire periphery of the horizontal rail 34. Optionally, only the uppermost surfaces of the side walls of the horizontal rail 34 and, similarly, the first and second shoulder rails 30 and 32 may be coated with the flocking fibers 44.

The method of manufacturing the two part hanger 10 and the two-part hanger 10 preparable by such a method includes the steps of:

(a) forming a hook portion having a substantially U-shaped end 18 and first and second inclined, diverging legs 20 and 22, (b) extruding a hollow tubular member 50 from an extrusion die which has first and second ends 38 and 40. The tubular member 50 is preferably formed of a suitable plastic material, such as a thermoplastic material, i.e., styrene, polypropylene, polyethylene or polyvinylchloride, and others, (c) bending the hollow tubular member 50 at opposite ends, as denoted by reference numbers 52 and 54 in FIG. 3, to form first and second inclined shoulder rails 30 and 32 shown in phantom in FIG. 3 which are connected by an integral, horizontal, planar rail 34 extending therebetween, and (d) slidably engaging the ends 38 and 40 of the first and second rails 30 and 32, respectively, with the first and second legs 20 and 22 of the hook portion 14.

In a preferred embodiment of the method, the hook portion 14 is formed by injection molding.

Figure 3:
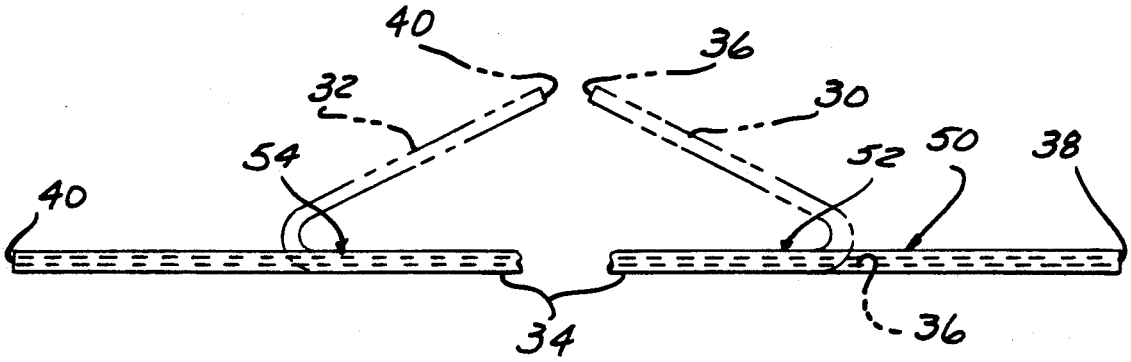
FIG. 3 is a side elevational view of the extruded tubular member used to form the second portion of the two-part plastic hanger shown in FIG. 1.

When a friction producing surface, such as flocking particles or fibers 44, is to be applied to certain portions of the second lower portion 16 of the hanger 10, a coating of a suitable adhesive 42 is applied to certain portions, such as the entire periphery of the horizontal rail 34 and substantially all of the entire periphery of the first and second shoulder rails 30 and 32. Preferably, the coating of adhesive 42 is applied to the elongated tubular member 50 immediately after the elongated tubular member 50 exits the extrusion dye and prior to the bending of the shoulder rails 30 and 32 into the desired angular position with respect to the horizontal rail 12, as shown in FIG. 3. Preferably, the coating of adhesive 42 is sprayed onto the tubular member 50 when the elongated tubular member 50 is at an elevated temperature after exiting the extrusion die or is raised to an elevated temperature through suitable heating means, not shown. The flocking fibers 44 are then sprayed onto the coating of adhesive 42 prior to the bending of the shoulder rails 30 and 32 to the desired angular shape shown in FIG. 3.

Figure 4:
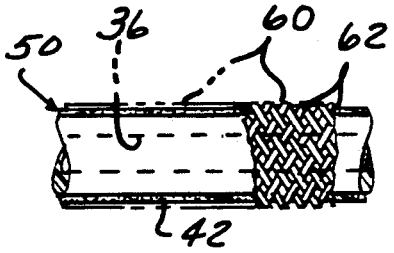
FIG. 4 is a partial, side elevational view of the extruded tubular member having another embodiment of the friction producing surface applied thereon.

In another embodiment shown in FIG. 4, the friction producing surface is formed of an interknit braid 60 of individual fiber strands 62. In this embodiment, the adhesive 42 is initially sprayed onto the elongated tubular member 50 immediately after the tubular member 50 exits the extrusion dye and prior to the bending of the shoulder rails 30 and 32 into the desired angular shape. A plurality of fiber strands 62 are then interknit by a conventional braiding machine over the coating of adhesive 42 to form a wound braid 60 which is secured to the tubular member 50 through the adhesive 42.

The friction producing surface may also be applied on the hanger 10 in a variety of other methods. For example, flocking can be attached to a thin fabric strip, such as a ribbon, which is then spiral wound over an adhesive coating previously applied to selected portions of the hanger 10. Alternately, a self contacting adhesive or a sprayed adhesive can be applied to the flocking strip or ribbon before the strip or ribbon is wound about the hanger 10.

Also disclosed in the present invention is a two-part plastic hanger having a hook portion with first and second inclined, depending legs preparable by the process of:

extruding an elongated hollow tubular member from a plastic material having first and second ends and bending the first and second ends to form first and second inclined shoulder rails joined by an integral horizontal rail. The first and second ends of the shoulder rails are engageable with the first and second legs, respectively, of the hook portion. Further, the two-part hanger preparable by the above-described process further includes the step of spraying flocking fibers over an adhesive coating previously sprayed onto certain portions of at least one of the first and second shoulder rails and the horizontal rail.

In summary, there has been disclosed a unique two-part hanger, method of producing the same and a two-part hanger preparable by the method which provides significant advantages over previously devised plastic hangers. By forming the hook portion with short depending legs, the hook portion may be injection molded in smaller dies and from smaller quantities of high cost injection molding plastic materials thereby decreasing the overall cost of the hanger of the present invention. Extruding the second lower portion of the hanger as an elongated tubular member enables the use of less expensive materials and smaller dies and machines and, further, higher production rates to form the second lower portion of the hanger. All of these features significantly reduce the cost of the hanger of the present invention as compared to previously devised plastic hangers.

Further, spraying an adhesive coating and flocking fibers onto the elongated tubular member after the tubular member has been extruded and prior to the bending of the shoulder rails in the tubular member significantly reduces waste of the adhesive and permits such fibers to completely coat all or any desired portion of the periphery of the second lower portion of the hanger. This minimizes waste which decreases costs as well as lowers the amount of floor space and equipment required to apply flocking to hangers.

Figure 5:
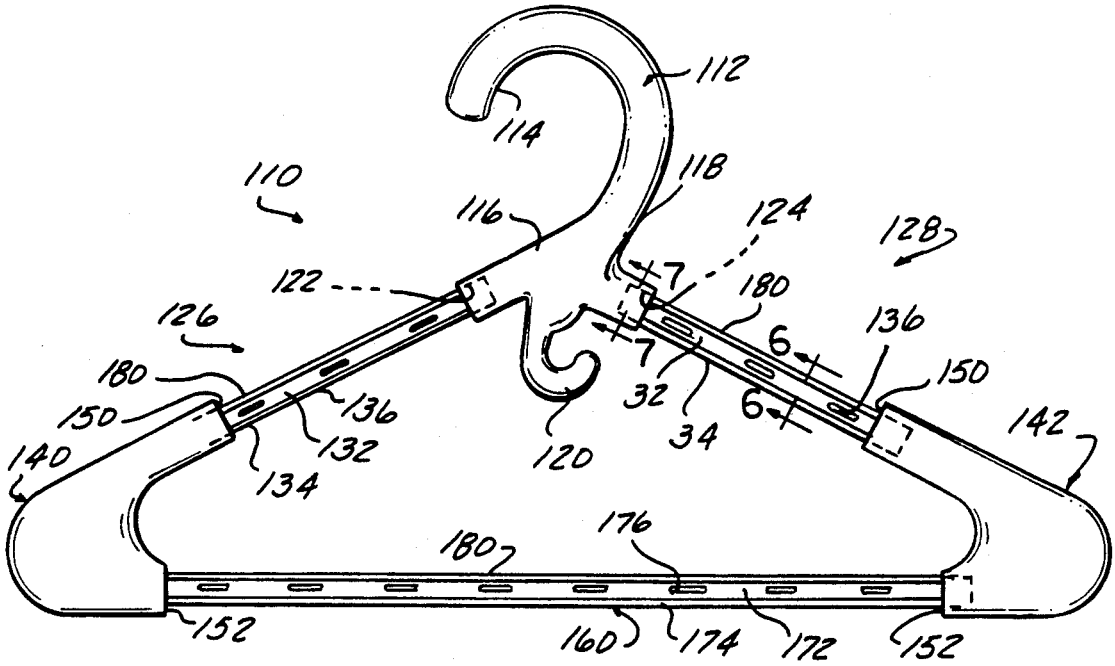
FIG. 5 is a front elevational view of a separable, multipart hanger with shoulder pads constructed in accordance with the teachings of the present invention.

Referring now to FIG. 5, there is illustrated a separable, multipart plastic hanger 110 which can be broken down into separate components for transport and storage in a minimal volume and, yet, may be assembled into a hanger having all of the features of a conventional one-piece hanger.

The hanger 110 includes a first hook member 112 having a conventional, U-shaped end 114 and integral, first and second, inclined, diverging legs 116 and 118. A lower, smaller hook 120 is integrally formed between the first and second leg 116 and 118 for attaching belts, neckties and other accessories to the hanger 110.

Preferably, the hook 112 including the U-shaped end portion 114, the first and second legs 116 and 118 and the lower hook 120 is formed as a one-piece member by injection molding in a single mold cavity. Any suitable plastic material may be used to form the hook 112 of the hanger 110.

It should be noted that the outermost ends of the first and second legs 116 and 118 are formed with hollow internal bores 122 and 124, respectively. The bores 122 and 124 respectively receive one end of first and second shoulder rails 126 and 128. The first and second shoulder rails 126 and 128 diverge outwardly from the hook 112 and shown in FIG. 5.

Figure 6:
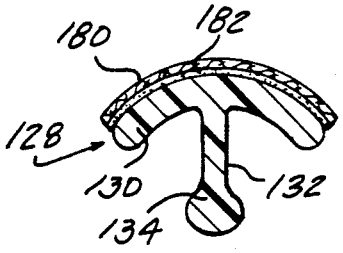
FIG. 6 is a cross sectional view generally taken along line 6—6 in FIG. 5.

The shoulder rails 126 and 128 are identically Constructed and, as shown by way of example in FIG. 6, include an upper arcuate shaped portion 130, a central leg portion 132 which depends perpendicularly from the upper portion 130 and an enlarged bottom portion 134. The shoulder rails 126 and 128 are formed by any suitable means. Preferably, however, the shoulder rails 126 and 128 are extruded through a die in a long continuous member having the cross-sectional shape shown in FIG. 6. The shoulder rails 126 and 128 are cut to a predetermined length from the extruded continuous member.

Figure 7:
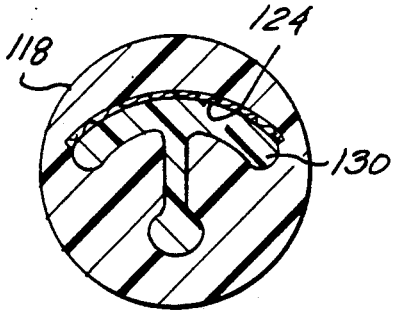
FIG. 7 is a cross sectional view generally taken along line 7—7 in FIG. 5.

It should be noted that the bores 122 and 124 in the first and second legs 116 and 118 of the hook means 112 have a cross section corresponding to the cross sectional shape of the shoulder rails 126 and 128, as shown in FIG. 7. This enables one end of the shoulder rails 126 and 128 to be fixedly, but separably, joined to the legs 116 and 118 by a press fit inside the bores 122 and 124, respectively.

As shown in FIG. 5, a plurality of generally oval apertures or cutouts 136 are spacedly formed in the central leg portion 132 of each of the shoulder rails 126 and 128. This is provided to reduce the weight of the shoulder rails 126 and 128.

In addition to the above-described shape, the shoulder rails 126 and 128 may have any other cross section, such as circular, square, etc. The bores 122 and 124 will have a similar shape.

Figure 8:
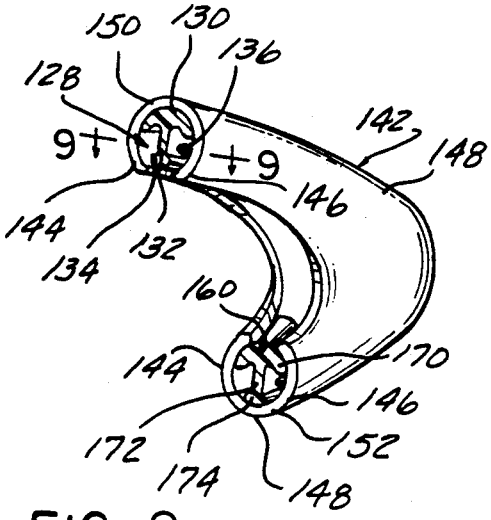
FIG. 8 is a perspective view of a shoulder cap employed in the hanger shown in FIG. 5.

A pair of first and second shoulder caps 140 and 142 are fixedly, but separably joined to the opposite ends of the shoulder rails 126 and 128. As shown in greater detail in FIGS. 8 and 9, each of the identically constructed shoulder caps 140 and 142, such as shoulder cap 142 shown in FIG. 8, has a generally arcuate shaped body formed of spaced side walls 144 and 146 which are joined by a central portion 148. The side walls 144 and 146 and the central portion 148 have a generally arcuate shaped interior surface, as shown in FIG. 8, to snugly conform to the arcuate shaped upper portion 130 of the shoulder rails 126 and 128. The outer surface of the central end portion 148 is formed with a generally smooth, convex shape along its length between a first end 150 and a second end 152 of each shoulder cap, such as shoulder cap 142 shown in FIG. 8. This provides a smooth surface for supporting articles on the hanger 110 and prevents the formation of wrinkles or creases in such articles of clothing.

Each of the shoulder caps, such as shoulder cap 142, curves arcuately from the first end 150 to a second end 152. The interior cross section of the second end 152 is designed to snugly receive one end of a horizontal rail 160, described in greater detail hereafter. Each of the shoulder caps 140 and 142 thus functions to provide an enlarged, smooth surface at the apex of the hanger 110 and, also, to separably join the shoulder rails 126 and 128 to the horizontal rail 160.

Figure 9:
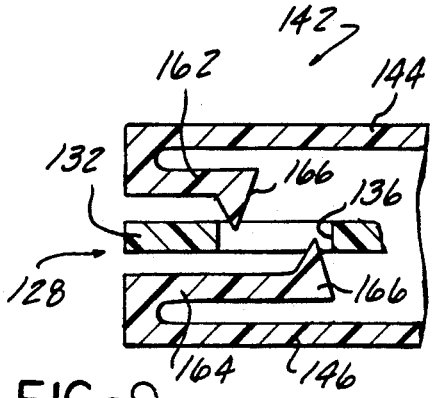
FIG. 9 is a cross sectional view generally taken along line 9—9 in FIG. 8.

Although the interior cross section of each of the shoulder caps 140 and 142 may be designed so as to snugly receive the shoulder rails 126 and 128 and the ends of the horizontal rail 160 therein, in a preferred embodiment, latch means are provided in each of the shoulder caps 140 and 142 for releasably latching one end of the shoulder rails 126 and 128 and one end of the horizontal rail 160 therein. As shown in FIG. 9, resilient latch members 162 and 164 are hingedly connected to the opposed legs 144 and 146, respectively, of each shoulder cap, such as shoulder cap 142. The latch members 162 and 164 are formed adjacent the first end 150 of the shoulder cap 142 as well as in a second pair adjacent the second end 152 of the shoulder cap 142. Similar latch members are also provided in the identically constructed first shoulder cap 140.

Each of the latch members 162 and 164 includes an enlarged, generally triangular shaped head 166 which has inclined side surfaces. The head portion 166 of each of the latch members 162 and 164 is adapted to snap into the endmost aperture 136 in the shoulder rail 126 or 128 as the shoulder rail 126 or 128 is slidably inserted into the first end 150 of the shoulder cap 140 or 142. The length of the leg portions of each of the latch members 162 and 164 is selected such that the head portion 166 of the latch member 162 engages one side wall of the endmost aperture 136, while the head end 166 of the opposed latch member 164 snugly engages the opposed side wall of the aperture 136. This retains the shoulder rail 126 or 128 snugly within the first end of the shoulder cap 140 or 142. However, an outward force exerted on the legs 144 and 146 of the first end 150 of the shoulder cap 140 or 142 will release the latch members 162 and 164 from the aperture 136 in the leg 132 of the shoulder rails 126 and 128 and enable the shoulder rails 126 and 128 to be separated from the shoulder caps 140 and 142 to disassemble the hanger 110.

A similar latching construction is provided at the second end 152 of the shoulder caps 140 and 142 for releasably connecting one end of the horizontal rail 160 to the shoulder caps 140 and 142. Further, a similar latch means may be formed in the legs 116 and 118 of the hook 112 to latch the opposite ends of the shoulder rails 126 and 128 to the hook 112.

The horizontal rail 160 is constructed identically as each of the shoulder rails 126 and 128 and has an arcuate shaped upper portion 170, a central depending leg 172 and an enlarged bottom 174 as shown in FIGS. 5 and 8. The horizontal rail 160 is also provided with a plurality of spaced apertures 176 which are spaced along the central depending leg 172 to reduce the weight of the horizontal rail 160.

A friction producing surface 180 is formed on the arcuate upper shaped portions 130 or 170 of the shoulder rails 126 and 128 and the horizontal rail 160. The friction surface 180 is preferably formed by coating the upper surface of the arcuate end portions 130 and 170 of the shoulder rails 126 and 128 and the horizontal rail 160, respectively, with an adhesive 182. Then, flocking fibers, by way of example, are sprayed onto the adhesive coating 182 and adhere to the upper portions 130 and 170 of the shoulder rails 126 and 128 and the horizontal rail 160, respectively. The flocking fibers form a friction producing surface 180 on the exposed upper portions of the shoulder rails 126 and 128 or the horizontal rail 160 for securely retaining garments on the shoulder rails 126 and 128 and/or the horizontal rail 160.

Due to the preferred use of an extrusion process for forming the shoulder rails 126 and 128 and the horizontal rail 160 in a continuous elongated strip before the shoulder rails 126 and 128 and the horizontal rail 160 are cut to length, the adhesive coating 182 and the flocking fibers 180 are preferably sprayed onto the upper arcuate shaped portions of the elongated strip and the elongated strip as it exits the extrusion die. This simplifies manufacturing of the hanger 110 and minimizes any waste of the flocking fibers and adhesive thereby reducing manufacturing costs for the hanger 110.

It should be noted that the hook 112, the shoulder rails 126 and 128, the shoulder caps 140 and 142 and the horizontal rail 160 may be formed of any suitable plastic material. The plastic materials employed to form the various elements of the hanger 110 may be different to suit the needs of either injection molding or extrusion processes.

Further, for cosmetic appearances, each of the elements of the hanger 110 may be formed in a different color. This provides an attractive appearance for the hanger 110 and enables the various components of the hanger 110 to be rearranged with the components of other, different colored hangers to suit the desires of a user.

After the components of the hanger 110 are formed, they may be packaged in the required numbers for a single hanger 110. Since the components are separate prior to assembly by the end user, the components may be packaged in a compact manner with no dead space between the components as compared to prior packaging techniques required for single, unitary hangers which include a large amount of wasted or dead space between the areas bounded by the shoulder rails and the horizontal rail. Such reduced volume not only saves packaging costs; but, also, minimizes transportation and storage requirements and costs due to the smaller packages required to store the hangers 110.

In summary, there has been disclosed a unique separable, multipart hanger which may be transported and stored prior to its use in a small, compact container. However, the hanger may be assembled by an end user into a conventional triangular shaped hanger for normal use. The hanger of the present invention also includes unique shoulder caps which interconnect the shoulder and horizontal rails of the hanger into a unitary assembly; but also provide an enlarged, smoothly curved surface at the apexes of the shoulder rails and the horizontal rail to smoothly support garments without creases or wrinkles. A friction producing surface may be applied to exposed portions of all or some of the shoulder rails and the horizontal rail to securely support garments on the hanger. Such a friction producing surface may be applied with minimal waste thereby lowering the manufacturing costs of the hanger of the present invention.

I claim:

1. A separable, multipart hanger comprising:

a hook portion, the hook portion having first and second diverging legs;

first and second shoulder rails releasably connectible at one end to the first and second diverging legs of the hook portion, respectively;

first and second shoulder caps releasably connectible to the other ends of the first and second shoulder rails, the first and second shoulder caps having a smoothly curved exterior surface; and a horizontal rail releasably connectible to the first and second shoulder caps.

2. The hanger of claim 1 wherein the first and second shoulder caps each further comprise:

latch means for releasably latching one end of a shoulder rail and a horizontal rail therein.

3. The hanger of claim 2 wherein the latch means comprises:

resilient latch members mounted on each end of the first and second shoulder caps, the resilient members having an enlarged head end portion;

an aperture formed in an endmost portion of the shoulder rails and the horizontal rail and wherein:

the resilient latch members engage the aperture in the shoulder rail and the horizontal rail to releasably connect one end of the shoulder rail and one end of the horizontal rail to the first and second shoulder caps.

4. The hanger of claim 1 wherein the first and second shoulder rails and the horizontal rail each comprise:

a body having an arcuate shaped upper portion, a central leg depending from the arcuate shaped upper portion and an enlarged end portion formed on the opposite end of the leg.

5. The hanger of claim 4 wherein:

a plurality of spaced apertures are formed in the central depending leg of each of the first and second shoulder rails and the horizontal rail.

6. The hanger of claim 1 further including:

a friction producing surface disposed on at least portions of at least one of the first and second shoulder rails and the horizontal rail.

7. The hanger of claim 6 wherein the friction producing surface comprises:

flocking particles adhesively attached to exposed portions of at least one of the first and second shoulder rails and the horizontal rail.

8. The hanger of claim 1 further including:

a second inverted hook integrally formed with the hook portion between the first and second diverging legs.

9. The hanger of claim 1 comprising:

bores formed in the ends of the first and second diverging legs of the hook portion;

one end of the first and second shoulder rails having a cross section complimentary to the cross section of the bores and releasably mountable in the bores.

10. The hanger of claim 1 comprising:

latch means, disposed in each of the first and second legs of the hook portion, for releasably latching one end of a shoulder rail to each of the first and second legs of the hook portion.

11. A separable, multipart hanger comprising:

a hook portion, the hook portion having first and second diverging legs;

first and second shoulder rails releasably connectible at one end to the first and second diverging legs of the hook portion;

first and second shoulder caps releasably joined to the opposite ends of the first and second shoulder rails at one end;

latch means for releasably latching one end of a shoulder rail and the horizontal rail to each of the first and second shoulder caps; and a friction producing surface formed on at least portions on one of the first and second shoulder rails and the horizontal rail.

12. The hanger of claim 11 wherein:

the first and second shoulder rails and the horizontal rail each include an arcuate shaped upper end portion, a central depending leg portion and an enlarged bottom portion; and a plurality of spaced apertures formed along the length of the central leg portion of each of the first and second shoulder rails and the horizontal rail.

13. The hanger of claim 11 wherein the friction producing surface comprises:

flocking particles adhesively attached to at least portions of the arcuate shaped end portions of at least one of the first and second shoulder rails and the horizontal rail.

* * * * *